US007001488B2

(12) United States Patent
Bowler et al.

(10) Patent No.: US 7,001,488 B2
(45) Date of Patent: Feb. 21, 2006

(54) METHOD OF AND APPARATUS FOR DISTRIBUTION OF PAPER STOCK IN PAPER OR BOARD MAKING MACHINERY

(75) Inventors: Harry Bowler, Lancashire (GB); John William Leach, Lancashire (GB)

(73) Assignee: Sandusky Technologies Limited, Edinburgh (GB)

( * ) Notice: Subject to any disclaimer, the term of this patent is extended or adjusted under 35 U.S.C. 154(b) by 463 days.

(21) Appl. No.: 10/252,206

(22) Filed: Sep. 23, 2002

(65) Prior Publication Data

US 2004/0055722 A1 Mar. 25, 2004

(51) Int. Cl.
*D21F 1/02* (2006.01)
*D21F 1/06* (2006.01)

(52) U.S. Cl. ..... 162/338; 162/336; 162/343

(58) Field of Classification Search ..... 162/123, 162/125, 198, 212, 216, 252, 258, 259, 336, 162/343, 380, DIG. 6, DIG. 10, 348; 137/561 A
See application file for complete search history.

(56) References Cited

U.S. PATENT DOCUMENTS

| | | | | |
|---|---|---|---|---|
| 3,640,063 A | | 2/1972 | Schmid et al. | |
| 3,791,918 A | | 2/1974 | Koskimies et al. | |
| 3,962,031 A | * | 6/1976 | Bubik et al. | 162/338 |
| 4,146,425 A | | 3/1979 | Gutzeit | |
| 4,445,974 A | | 5/1984 | Stenberg | |
| 4,637,439 A | | 1/1987 | Jeans | |
| 4,804,441 A | | 2/1989 | Lyytinen | |
| 4,888,094 A | | 12/1989 | Weisshuhn et al. | |
| 4,909,904 A | | 3/1990 | Kinzler | |
| 5,022,965 A | | 6/1991 | Pitkajarvi | |
| 5,098,523 A | | 3/1992 | Ilmarinen et al. | |
| 5,133,836 A | | 7/1992 | Allen | |
| 5,545,293 A | | 8/1996 | Huovila et al. | |
| 5,549,792 A | * | 8/1996 | Begemann et al. | 162/216 |
| 5,626,722 A | * | 5/1997 | Huovila | 162/343 |
| 5,688,372 A | | 11/1997 | Huovila et al. | |
| 5,700,357 A | | 12/1997 | Didier | |
| 5,709,777 A | * | 1/1998 | Begemann et al. | 162/216 |
| 5,800,678 A | | 9/1998 | Pitkajarvi | |
| 5,814,191 A | * | 9/1998 | Huovila | 162/216 |
| 6,030,500 A | * | 2/2000 | Haraldsson et al. | 162/343 |
| 6,153,057 A | * | 11/2000 | Aidun | 162/343 |
| 6,368,462 B1 | * | 4/2002 | Lumiala et al. | 162/258 |
| 6,464,837 B1 | * | 10/2002 | Ruf et al. | 162/338 |

FOREIGN PATENT DOCUMENTS

| | | |
|---|---|---|
| DE | 9115296.8 | 4/1992 |
| DE | 4239845 C2 | 5/1993 |
| DE | 4323263 A1 | 1/1994 |
| DE | 297 02 362 U1 | 6/1997 |
| EP | 0442257 B1 | 8/1991 |
| EP | 0462472 A1 | 12/1991 |
| EP | A-0635599 A1 | 1/1995 |
| WO | WO 86/01844 | 3/1986 |
| WO | WO 93/22495 | 11/1993 |
| WO | WO 97/48851 A1 | 12/1997 |
| WO | WO 00/66831 A1 | 11/2000 |

* cited by examiner

*Primary Examiner*—Eric Hug
(74) *Attorney, Agent, or Firm*—MacMillan, Sobanski & Todd, LLC

(57) ABSTRACT

An inlet chamber is connected to a nozzle section by way of a plurality of tubes. Diluting liquid for mixing with paper stock flowing through one or each of said tubes is fed into the tube via annular inlet means. To ensure thorough mixing, channel means leading into the annular inlet means is configured to create turbulent flow of diluting liquid prior to its introduction into the tube, for example, by consisting of a helical or spiral duct, or by being provided internally with baffle means.

11 Claims, 3 Drawing Sheets

METHOD OF AND APPARATUS FOR DISTRIBUTION OF PAPER STOCK IN PAPER OR BOARD MAKING MACHINERY

BACKGROUND OF THE INVENTION

This invention concerns a method of and apparatus for improving control of the distribution of paper stock in a paper or board making machine.

Conventionally, paper stock is distributed onto a forming section of a paper or board making machine by passing it through a head box, which comprises an inlet chamber, known as an inlet header, connected to a nozzle section by way of a plurality of tubes or ducts.

Some known types of head box as described, for example in EP-A-0 635 599 and U.S. Pat. No. 5,545,293, are more complex in structure and the plural tubes connecting the inlet header to the nozzle section or comparable discharge duct are arranged in a series of groups disposed side by side and one above the other. Furthermore, a first series of such groups lead from the inlet header into an intermediate chamber, to which an attenuation chamber for purposes of pressure equalization is connected, while a second series of such groups lead from the intermediate chamber into the nozzle or discharge duct.

The present invention is applicable to both the simpler and more complex types of head box.

The aforesaid specifications describe how, in order to regulate the distribution of paper stock, namely paper pulp suspension, a dilution flow may be introduced into at least one of the tubes of the second series. In particular this dilution flow, which may comprise only water, is introduced into a mixing chamber section of a tube, which section leads immediately from the intermediate chamber in the direction of flow. Moreover, this dilution flow may enter the tube annularly from around a narrower pipe through which the original paper stock is fed into the mixing chamber.

SUMMARY OF THE INVENTION

The invention provides paper stock distribution apparatus for a paper or board making machine comprising an inlet chamber connected to a nozzle section by way of a plurality of tubes, at least one of said tubes having annular inlet means whereby a diluting liquid may be fed in for mixing with paper stock flowing through said tube, characterized in that channel means leading into said annular inlet means is configured to create turbulent flow of diluting liquid prior to its introduction into the tube.

Creating turbulence within the dilution liquid flow before it enters the tube enhances and speeds up the mixing of said liquid into the existing paper stock flow so that regulation of the distribution of the resultant mixture may be more accurately achieved.

The turbulent flow created may be generally swirling, or more specifically helical, or of any other pattern.

Thus the channel means provided to create this flow may comprise, for example, at least one helical or spiral duct disposed to feed liquid tangentially into the annular inlet means, or a duct provided internally with baffle means which serves to feed liquid, tangentially or radially or longitudinally, or any intermediate of these into the annular inlet means.

An object of the invention is to improve the mixing of incoming dilution flow with the existing flow of stock in any type of head box.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
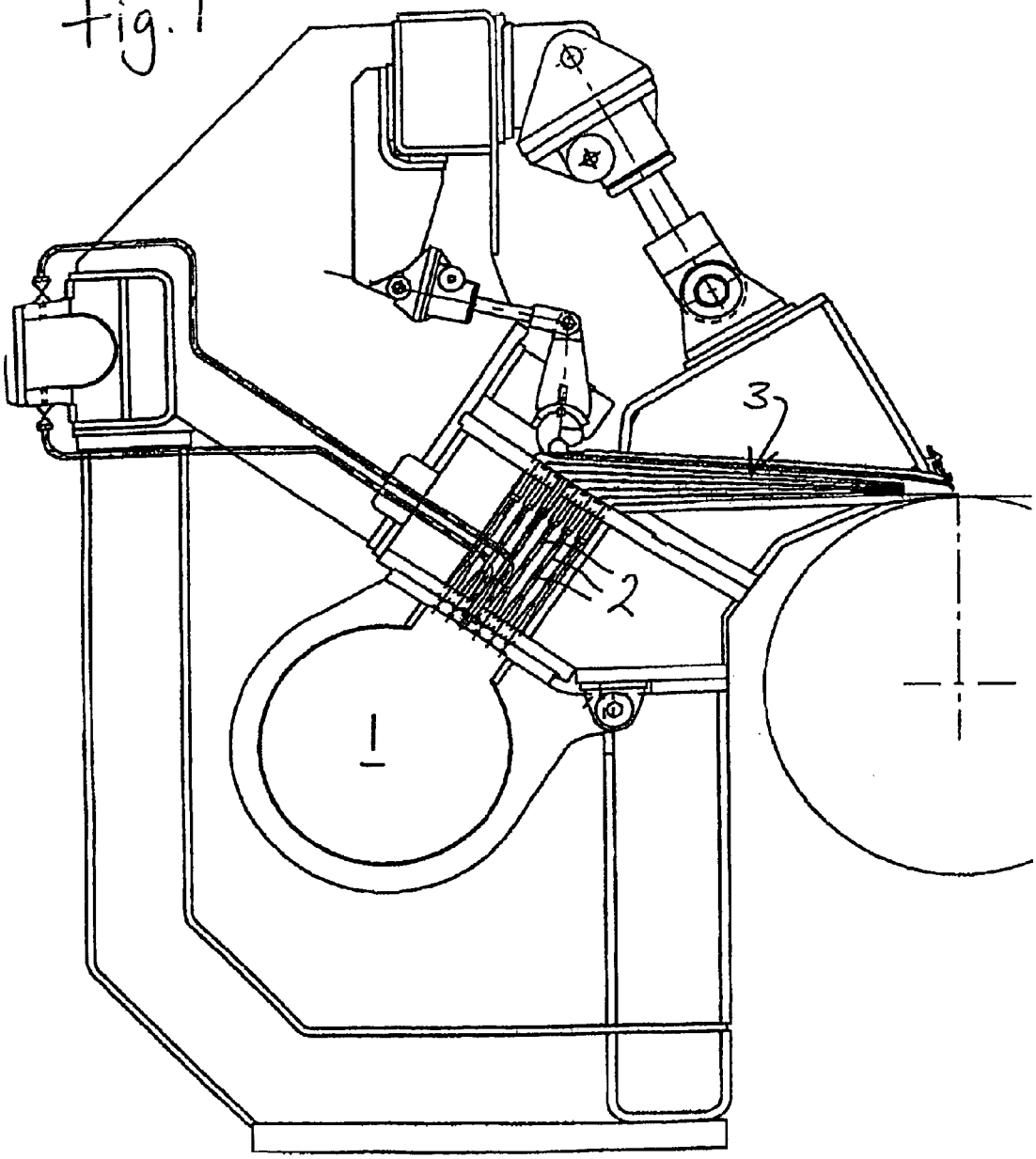
FIG. 1 is a schematic side view of that part of a papermaking machine for use with the present invention.

With reference to FIG. 1, paper stock is distributed onto a papermaking machine by passing it through an hydraulic head box. In the illustrated embodiment, the head box consists of an inlet header 1 connected by way of multiple tubes 2, which are arranged in rows across the machine, to the upstream part of a nozzle section 3. In conventional manner, the cross-sectional area of the header 1 decreases across the width of the machine in order to maintain an even pressure in the stock which flows therefrom. This decrease in area is not apparent in the drawings.

Figure 2:
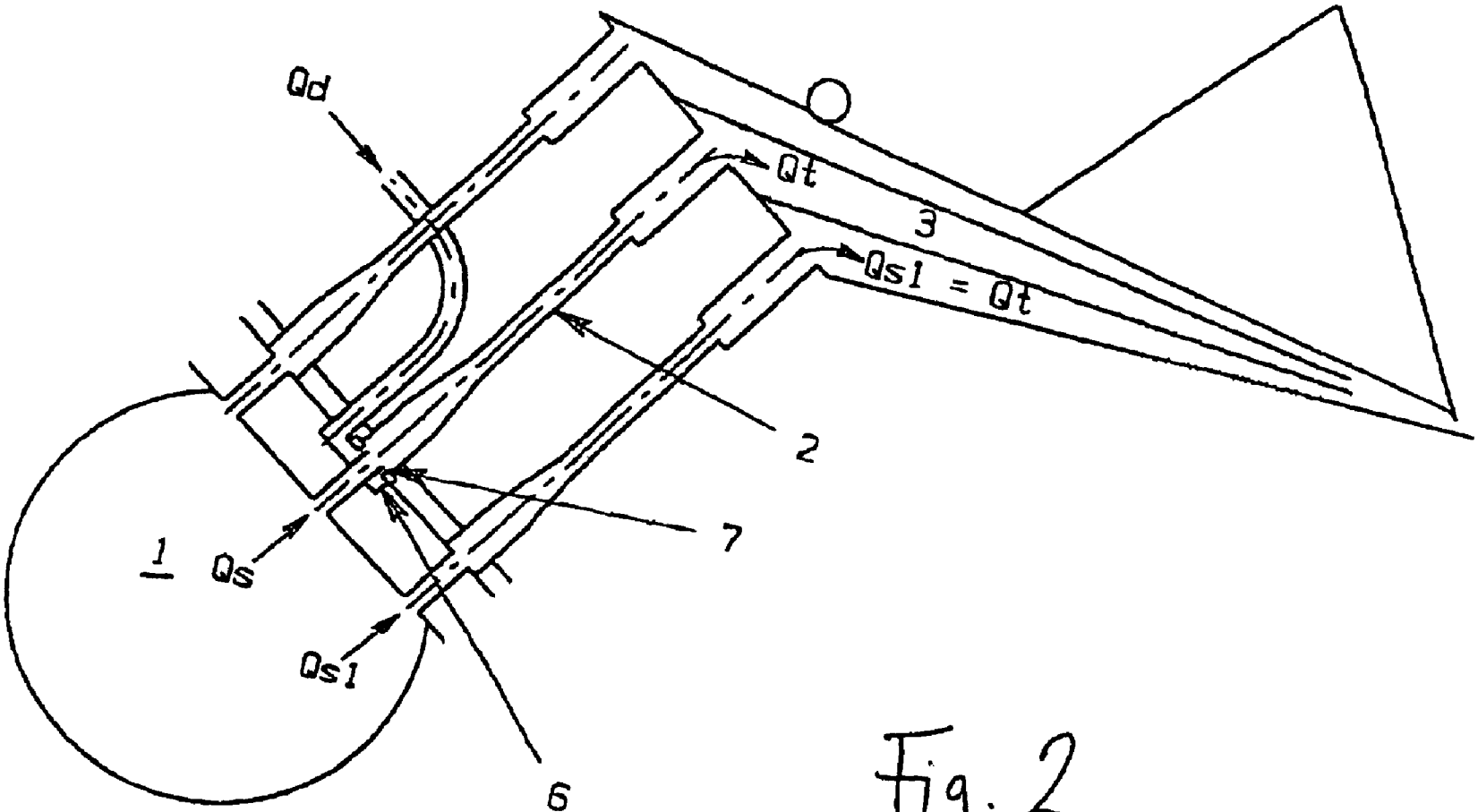
FIG. 2 is an enlarged diagrammatic cross section of that part of the apparatus of FIG. 1 to which the present invention is applied.

In use, as shown in FIG. 2, the initial paper stock Qs is caused to flow under pressure from the header 1, through the tubes 2 and through the nozzle 3 from whence it is discharged as Qt onto the papermaking machine forming section.

In order to spread the paper stock and resulting paper web mass evenly across the width of the machine, dilution water Qd is added to at least one tube 2. The amount of dilution may be individually controlled at each position. i.e., at each tube 2, across the width of the head box.

Figure 3:
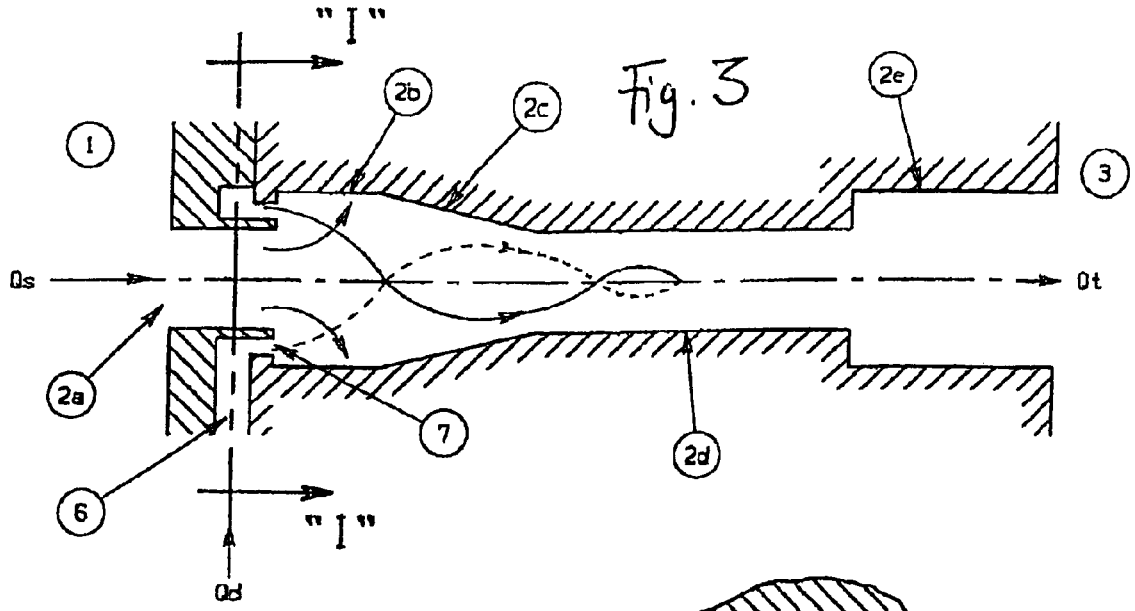
FIG. 3 is an enlarged diagrammatic cross section of part of the apparatus of FIG. 2 showing a tube having inlet means in accordance with the invention.
Figure 4:
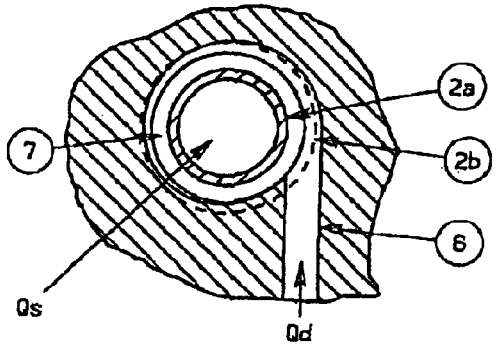
FIG. 4 is a cross section along line I—I in FIG. 3 in the direction indicated by the arrows.

As shown in FIGS. 3 and 4, each tube 2 comprises a number of different sections along its length. An upstream section 2*a* extends from the inlet header 1 to an adjacent section, termed a mixing chamber 2*b*. Around the downstream end of the tube section 2*a* a duct 6 is arranged on a spiral course of reducing radius with its inlet tangential to the tube section 2*a* and its outlet into the tube section 2*a* in the form an annulus 7. In use, this duct 6 discharges dilution water Qd into the mixing chamber 2*b*.

Figure 5:
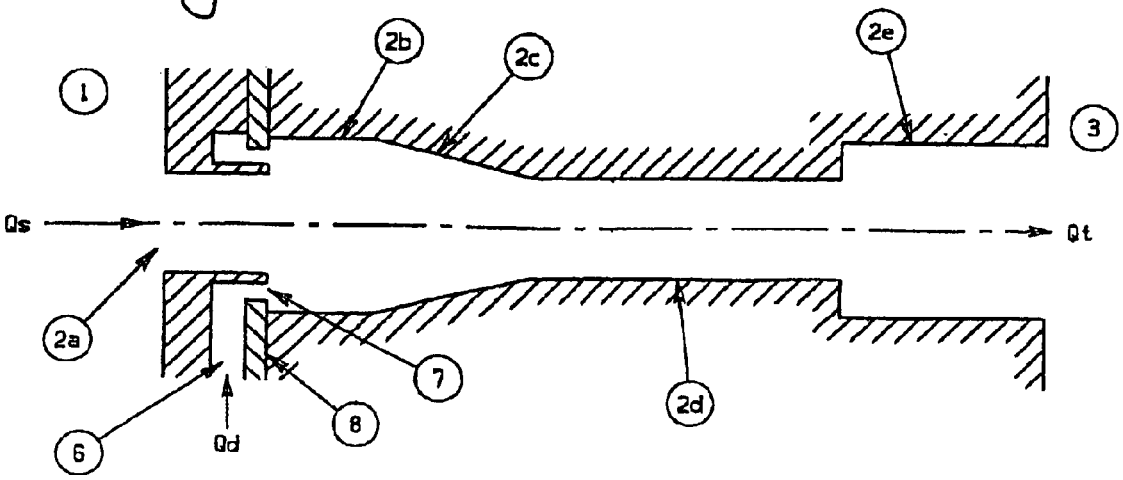
FIG. 5 is a view similar to FIG. 3 showing a modified embodiment of the invention.

Alternatively, as shown in FIG. 5, the annulus 7 may be formed by a circular opening in an insert plate 8.

In both FIG. 3 and FIG. 5 the mixing chamber 2*b* has a larger diameter than the upstream tube section 2*a* and the annular inlet 7. The downstream end of the mixing chamber 2*b* leads to a frusto-conical tapering section 2*c*, which reduces in diameter to the upstream end of the following tube section 2*d*. The downstream end of this latter section 2*d* is in connection with the upstream end of the tube section 2*e*, which is substantially larger in diameter than the tube section 2*d* and forms a turbulence chamber. The downstream end of the turbulence chamber 2*e* discharges into the nozzle section 3.

The foregoing is illustrative and not limitative of the scope of the invention. Many variations in the detail of the design, both of the duct leading to the annular opening for inflow of dilution water and of the overall head box are possible. For example, the inflow duct may be provided with baffle means as an alternative to a spiral or helical course so long as turbulent flow is created to enhance mixing in the chamber 2*b*. The inflow duct may be a tube or it may be formed as a passageway through a block of material. The head box may include additional components, such as an intermediate chamber, as mentioned in the introduction hereto, and inflow ducts in accordance with the invention may be applied to any tube within the head box.

We claim:

1. Paper stock distribution apparatus for a paper or board making machine comprising an inlet chamber connected to a nozzle section by way of a plurality of tubes, at least one of said tubes having annular inlet means whereby a diluting liquid can be fed in for mixing with paper stock flowing through said tube and having channel means leading into said annular inlet means, said channel means comprising a helical duct of reducing radius having an inlet tangential to said tube to create turbulent flow of diluting liquid prior to its introduction into said tube.

2. Paper stock distribution apparatus for a paper or board making machine comprising an inlet chamber connected to a nozzle section by way of a plurality of tubes, at least one of said tubes having annular inlet means whereby a diluting liquid can be fed in for mixing with paper stock flowing through said tube and having channel means leading into said annular inlet means, said channel means comprising a spiral duct of reducing radius having an inlet tangential to said tube to create turbulent flow of diluting liquid prior to its introduction into said tube.

3. Paper stock distribution apparatus comprising at least one tube positioned between an inlet header and a nozzle section, said tube having a mixing chamber for paper stock and diluting liquid, said mixing chamber being connected to a helical duct of reducing radius having an inlet portion being tangential to said tube and an annular inlet being in communication with said mixing chamber, whereby said duct creates turbulent flow of diluting liquid prior to its introduction into said mixing chamber through said annular inlet.

4. The apparatus of claim 3, wherein said tube has an upstream section adjacent to said inlet header and a downstream section adjacent to said nozzle section, said mixing chamber being positioned between said upstream and downstream sections.

5. The apparatus of claim 4, wherein said mixing chamber has a larger diameter than said upstream section.

6. The apparatus of claim 4, wherein said mixing chamber has a frusto-conical tapering section adjacent to said downstream section.

7. The apparatus of claim 4, wherein said downstream section has a latter section having a smaller diameter than said mixing chamber.

8. The apparatus of claim 4, wherein said downstream section has a turbulence chamber adjacent to said nozzle section.

9. The apparatus of claim 3, wherein said annular inlet is an annulus.

10. The apparatus of claim 3, wherein said annular inlet is a circular opening defined by an insert plate.

11. The apparatus of claim 3, wherein said mixing chamber is defined by an internal wall of said tube, said annular inlet being positioned adjacent to said wall.

* * * * *